United States Patent [19]

Petit

[11] Patent Number: 4,678,259

[45] Date of Patent: Jul. 7, 1987

[54] METAL JUNCTION BOX FOR PLUG-IN MULTICONTACT CONNECTOR

[75] Inventor: André Petit, Longpont sur Orge, France

[73] Assignee: Alcatel, Paris, France

[21] Appl. No.: 820,291

[22] Filed: Jan. 21, 1986

[30] Foreign Application Priority Data

Jan. 23, 1985 [FR] France ..... 85 00928

[51] Int. Cl.[4] ..... H01R 13/648

[52] U.S. Cl. ..... 439/610; 339/14 R; 339/139 R

[58] Field of Search ..... 339/14 R, 143 R, 136 R, 339/138, 139 R, 139 C, 92 M

[56] References Cited

U.S. PATENT DOCUMENTS

| | | | |
|---|---|---|---|
| 2,761,108 | 8/1956 | Jackson et al. | 339/92 M X |
| 3,718,889 | 2/1973 | Bartlett | 339/138 X |
| 4,457,576 | 7/1984 | Cosmos et al. | 339/143 R |

FOREIGN PATENT DOCUMENTS

| | | | |
|---|---|---|---|
| 1019822 | 2/1966 | United Kingdom | 339/138 |

*Primary Examiner*—Eugene F. Desmond

*Attorney, Agent, or Firm*—Sughrue, Mion, Zinn, Macpeak, and Seas

[57] ABSTRACT

A metal junction box effects connection of a cable (13) having a grounding shield (15) surrounding insulated electrical conductors (17) which extending out from the end of the said shield, and connected to a multi-pin connector plug (10). The box is equipped with a sleeve (4) over which the grounding shield (15) is fitted and held in place around the sleeve by a ferrule (19). The box is formed by a bracket (1) consisting of a central arm (2) and two, right angle side arms (3). Two lateral covers (11), have flanges (12) orthagonal to the planes of the covers (11). The sleeve (4) is coaxial of the bracket. The bracket (1) includes on its two side arms (3) two double mounting lugs (6) against which the two covers (11) are screwed from opposite sides. The ends of the two side arms terminate in tabs (7) directed toward each other. A metal plate (9) of the connector plug (10) is pressed at its ends against the tabs (7). The flanges of the cover (11) overlie the edges of the bracket (1) and aligned edges of the metal plate (9). The box physically protects the conductors (17), holds the cable (13) in place and provides excellent shielding due to the good electrical contact between the grounding shield (15) and the box and the presence of the flanges (12) surrounding the edges of the bracket (1) and the metal plate (9) of the connector plug (10).

2 Claims, 1 Drawing Figure

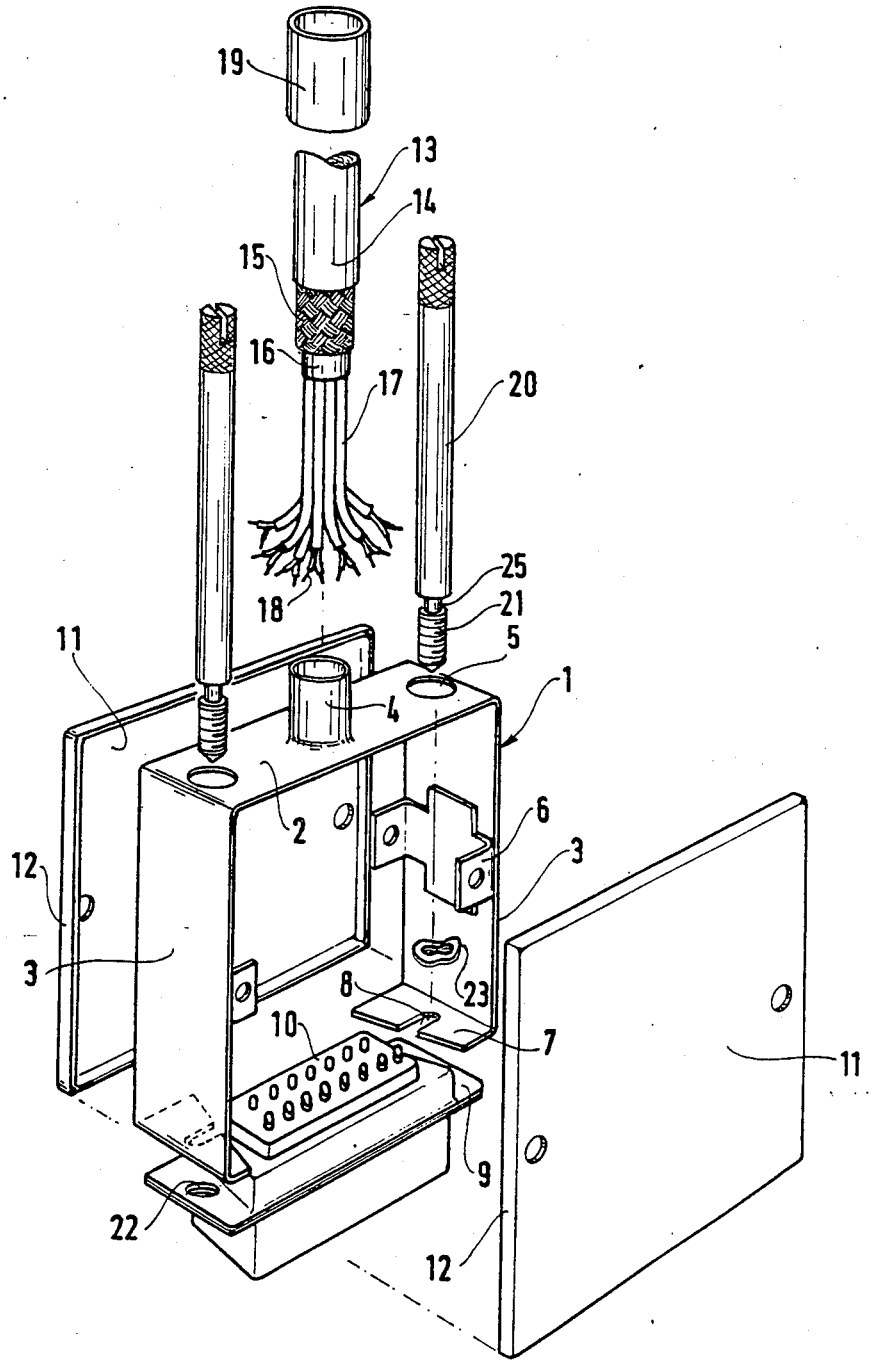
19
13
14
15
16
17
20
25
21
5
18
11
4
1
2
6
3
12
3
8
23
10
7
11
9
22
12

METAL JUNCTION BOX FOR PLUG-IN MULTICONTACT CONNECTOR

FIELD OF THE INVENTION

This invention relates to a metal box for conection of a cable with a grounding shield surrounding insulated electrical conductors extending out from the end of the said shield, the ends of the conductors being connected to a multi-pin connector plug, the said box being equipped with a sleeve over which the end of the grounding shield is fitted, the said end being held in place around the sleeve by a ferrule.

BACKGROUND OF THE INVENTION

A box of this type is described in the patent U.S. Pat. No. 3,391,381.

In the known box, the installation of the cable and conductors is very difficult, moreover the support is not metallic, and the function of shielding against external electromagnetic interference is accomplished only by the addition of an extra box.

SUMMARY OF THE INVENTION

The box according to the invention providing very good shielding against external electromagnetic interference and being very easy to install is characterized in that the said box contains a bracket consisting of a central arm and two side arms and laterally two covers equipped with flanges orthogonal to the planes of the covers, the said sleeve being fixed to the central arm of the bracket and directed along the axis of the bracket, and in that the bracket includes on its two side arms two double mounting lugs against which the two covers are screwed as well as, at the ends of its two side arms, two tabs directed toward the inside, against which the metal plate of the connector plug is pressed, the said plate being confined between the tabs bent inwards and the flanges of the covers, the edges of the bracket being covered over by the flanges of the covers.

The ends of the conductors are confined within a volume sealed against electromagnetic interference by means of the cover flanges.

In addition, the presence of the sleeve of the bracket provides a very good electrical connection between the grounding shield and the bracket.

According to one improvement of the invention, the central arm and the folded tabs are equipped with cutouts on the edges of which two through bolts are installed which pass through the holes at each side of the sleeve on the central arm, the through bolts each having one threaded end passing through the metal plate of the connector plug and which can be screwed into a hole tapped in the adjacent cabinet or chassis.

BRIEF DESCRIPTION OF THE DRAWING

This invention will be better understood by reference to the following description in connection with the single FIGURE which shows an exploded view of the box assembly, according to the invention.

DESCRIPTION OF THE PREFERRED EMBODIMENT

The box contains a metal bracket 1 including a central arm 2 and two side arms 3 orthogonal to the central arm 2.

Mounted in the middle of the central arm 2 is a sleeve 4 with the same axis as the bracket 1 and two holes 5 placed on either side of the sleeve 4.

Each arm 3 is equipped at mid height with a double lug 6 and at its lower end with a short tab 7 directed toward the inside of the bracket 1 and equipped with a slot 8 directly in line with one of the holes 5.

The metal plate 9 of a multi-pin connector plug 10 is applied against the tabs 7.

Two metal covers 11 equipped with flanges 12 are screwed onto the double lugs 6 which are provided with tapped holes for this purpose. The metal support 9 is confined between the tabs 7 and the flanges 12 of the covers. The flanges 12 surround the plate 9, the side arms 3 and the central arm 2 of the bracket 1.

The FIGURE also shows the end of a cable 13. This end contains a grounding shield 15 which extends beyond the outer insulating covering 14 of the cable 13 by a length equal to the height of the sleeve 4.

An inner insulating sleeve 16 extends beyond the grounding shield 15, and pairs of shielded electrical conductors 17 extend out from the inner sleeve 16.

In the assembled box the ends 18 of the shielded pairs of conductors 17 are connected to the multi-pin connector plug 10.

The grounding shield 15 is fitted over the sleeve 4 which is then positioned between the grounding shield 15 and the inner sleeve 16.

A soft metal ferrule 19, of copper for example, is fitted around the end of the grounding shield 15. This ferrule 19 is deformed by crimping so as to obtain a solid fit between the sleeve 4, the ferrule 19 and the grounding shield 15. This provides excellent electrical continuity between the box and grounding shield 15.

The box is provided with two cylindrical through bolts 20 each having one end threaded 21 and a groove 25 adjacent to this threaded end. These bolts 20 pass through the holes 5 and are fitted into the slots 8, letting the threaded end 21 pass through; the through-bolt grooves 25, introduced into the slots 8 of the bracket tabs, provide a captive fitting for the bolts. These ends 21 pass through the holes 22 of the connector plate 9 and are screwed into the tapped holes of a cabinet or chasses (not shown).

Friction washers 23 can be placed between the through bolts 20 and tabs 7. The through bolts, once in place, extend beyond the holes 5 so that they can be screwed and unscrewed.

I claim:

1. In a metal box for connection of a cable (13) having a grounding shield (15) surrounding insulated electrical conductors (17) which extend out from the end of the said shield, the ends (48) of the conductors (17) being connected to a multi-pin connector plug (10), said box being equipped with a sleeve (4) over which the grounding shield (15) is fitted, the said end being held in place around the sleeve by a ferrule (19), the improvement wherein the said box includes a bracket (1) consisting of a central arm (2) and two, right angle, parallel side arms (3), two lateral covers (11) terminating in flanges (12) orthogonal to the planes of the said covers (11), said sleeve (4) is fixed to the central arm (2) of the bracket (1) and directed along the axis of the bracket, and wherein said bracket (1) includes on its two side arms (3) double mounting lugs (6), respectively, said two covers (11) being screwed to said double mounting lugs from opposite sides of the box, said side arms terminating at ends remote from said central arm and in respective tabs (7) directed toward the inside against said connector plug (10) said plug including a metal plate (9) pressed against said tabs, the said plate (9) having ends abutting said tabs (7) and wherein said flanges (12) of said covers (11), overlie respective edges of the bracket (1) and aligned edges of the said metal plate such that the box physically protects the conductors (17), holds the cable (13) in place and provides shielding due to the good electrical contact between the grounding shield 15 and the box and the flanges 12 surrounding the edges of the bracket (1) and the metal plate (9) of the connector plug (10).

2. The metal box according to claim 1, wherein the central arm (2) of the bracket (1) is provided with holes (5) on either side of the sleeve (4), said tabs (7) include slots aligned with said holes (5) of said central arm, said tabs facing each other, and through bolts (20) passing through the holes (5) of the central arm (2) on either side of the sleeve (4), and said slots respectively, said metal plate including threaded holes (22) alignable with said slots (8) within said tabs and holes (5) within said central arm, and said through bolts each having one threaded end (21) which passes through a respective threaded hole of said plate (9) of the connector plug (10) such that a portion thereof extends beyond said hole (22) for reception into a hole in an adjacent cabinet or chassis.

* * * * *